US006439926B1

(12) United States Patent
Kuan

(10) Patent No.: US 6,439,926 B1
(45) Date of Patent: Aug. 27, 2002

(54) COMMUNICATION CONNECTOR

(76) Inventor: Chi-te Kuan, 5F, No. 82-3, Dong Shoenn St., Shulin Chen, Taipei Hsien (TW)

( * ) Notice: Subject to any disclaimer, the term of this patent is extended or adjusted under 35 U.S.C. 154(b) by 0 days.

(21) Appl. No.: 09/607,858

(22) Filed: Jun. 29, 2000

(51) Int. Cl.[7] ..... H01R 13/648

(52) U.S. Cl. ..... 439/607; 439/79

(58) Field of Search ..... 439/79, 607, 675

(56) References Cited

U.S. PATENT DOCUMENTS 5,439,394 A * 8/1995 Ikeda ..... 439/675
5,759,069 A * 6/1998 Kitatani et al. ..... 439/675
6,077,120 A * 6/2000 Futatsugi et al. ..... 439/607
6,083,046 A * 7/2000 Wu et al. ..... 439/607
6,139,350 A * 10/2000 Mathesius ..... 439/607

* cited by examiner

*Primary Examiner*—Gary F. Paumen
(74) *Attorney, Agent, or Firm*—Pro-Techtor International Services

(57) ABSTRACT

A communication connector, to be assembled to a mobile phone, providing charging functions and connection with outside communication, comprising: an insulating unit, an obstruction unit, and conductive terminals, contact point terminals and charging terminals that are accommodated respectively in the insulating unit, where the insulating unit is a flattened and elongated square shape, and arranged crosswise are terminal accommodating grooves, contact point terminal accommodating grooves, and charging terminal units, and the obstruction unit has a charging slot that is framed to match the charging terminal unit; with the charging slot directly framed by the obstruction, it enables reduction of integral height of the communication connector, and prevents the charging slot from interference of outside signals.

11 Claims, 3 Drawing Sheets

COMMUNICATION CONNECTOR

BACKGROUND OF THE INVENTION

1. Field of the Invention

The invention relates to a communication connector, particularly a compact and lightweight communication connector that is assembled to a mobile phone with communication and charging functions.

2. Description of Related Art

Conventionally, a communication connector related to the present invention is assembled to a mobile phone, such a connector is generally equipped with a DC charging slot to facilitate portability of the mobile phone, as well as charging of sufficient power. As illustrated in FIG. 8, a prior art of communication connector 8 is equipped with a conductive terminal 80 and a contact point terminal 81 and a charging terminal 82 for charging purpose. However, a conventional charging slot 83 accommodating the charging terminal 82 is monobloc formed with a connector plastic casing 84. In other words, the plastic casing 84 has formed a round insert hole, and the charging terminal 82 at the center. Taking into consideration the plastic injection forming process, the integral thickness has a certain proportion, therefore, the size of such a connector cannot be reduced. As shown in FIG. 9, the height of a conventional communication connector 1 is approximately at 6.8 mm after it is assembled to the circuit foundation board 90 of a mobile phone. However, such cubic measurements could not meet the current trend for compact size and light weight. Furthermore, high quality of transmitted signals is also required for a mobile phone. The structure of conventional communication connector 1 that is coated merely by plastics could not prevent interference from outside signals, but if a metal obstruction is used to surround it, the integral thickness will be increased, which is not desirable in the design for compactness and light weight.

SUMMARY OF THE INVENTION

It is therefore an objective of this invention to provide a communication connector. The connector will effectively prevent interference of foreign signals by the equipment of an excellent obstruction unit. Its cubic measurements will be lighter and thinner than the conventional models, so as to reduce the integral measurements of the mobile phone, in order to meet the design for compactness and light weight.

CHARACTERISTICS OF THE INVENTION

The present invention of communication connector is characterized in that: the charging slot of the connector is framed by a metal obstruction unit in combination with an insulation unit of the connector, to form a low-profile body. Referring to the main characteristic, the charging slot is framed in a square shape.

Another characteristic of the invention of communication connector lies in that, the metal obstruction unit has a location identifying unit opposite the charging slot, the location identifying unit serves to provide correct insertion and connection to a matching charging plug.

Referring to the above characteristic, the location identifying unit has a long depressed groove on the shorter outside of the obstruction unit and opposite the square shaped charging slot.

BRIEF DESCRIPTION OF DRAWINGS

The invention can be fully understood by reading the following detailed description of the preferred embodiments, with reference made to the accompanying drawings, wherein.

BRIEF DESCRIPTION OF NUMERALS

Figure 1:
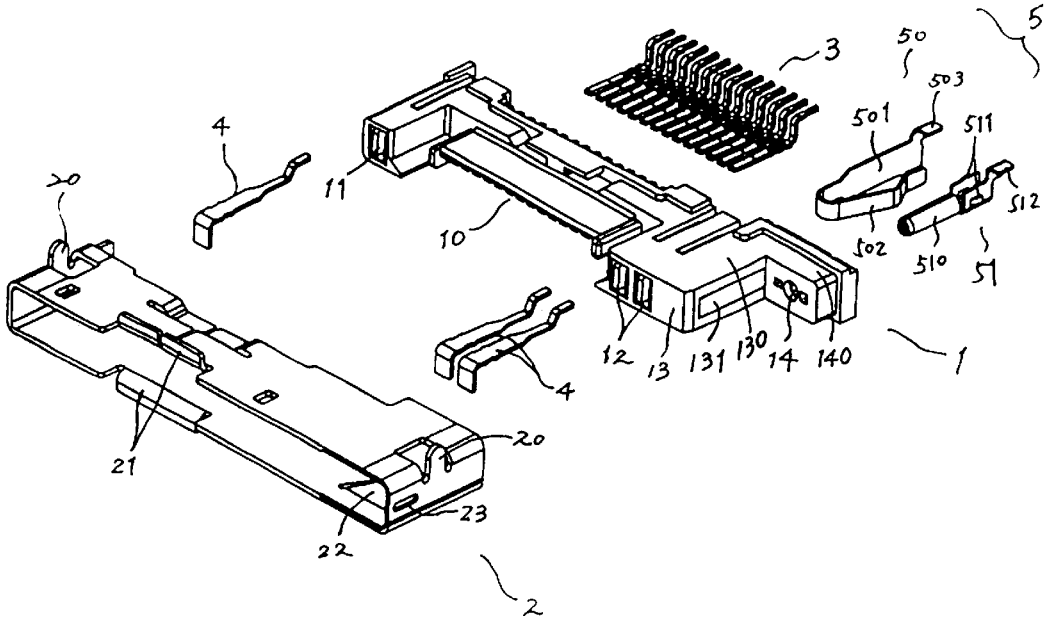
FIG. 1 is a perspective, disassembled view of the invention.

1 insulating unit
2 obstruction unit
3 terminal
4 contact point terminal
5 charging terminal
10 terminal accommodating groove
11, 12 contact point terminal accommodating groove
13 first charging terminal unit
14 assembling hole
15 connecting space
16 charging slot
20 positioning post
21 stop plate
22 check plate
23 position-identifying unit
60 circuit board
61 DC plug
501 foundation part
502, 510 contact part
503, 512 welding part
511 interference part

DETAILED DESCRIPTION OF PREFERRED EMBODIMENTS

Figure 3:
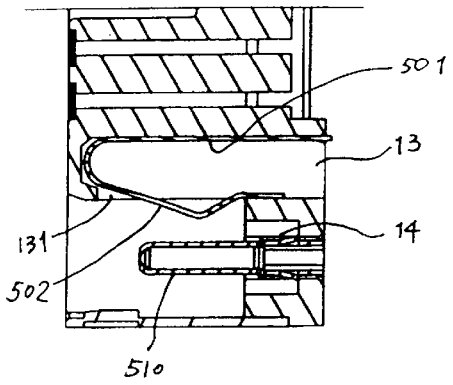
FIG. 3 is a section view along the line A—A marked in FIG. 2.
Figure 5:
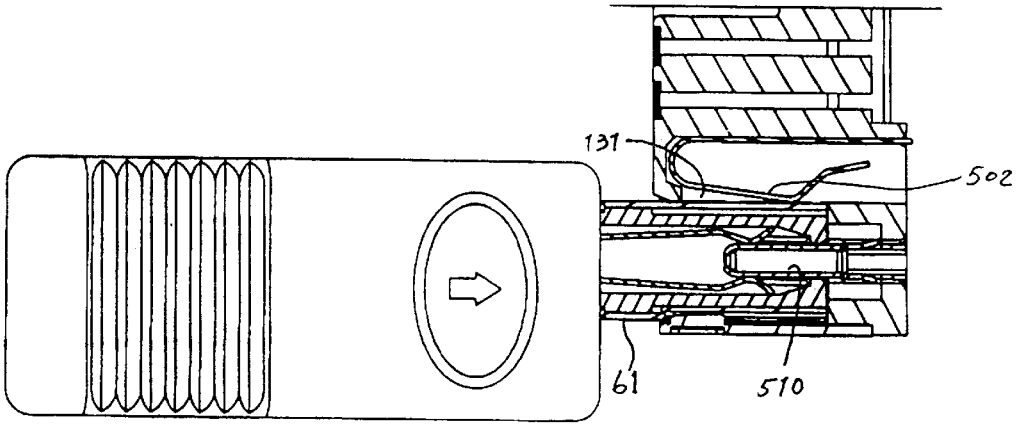
FIG. 5 is a section view of a DC charging plug that is inserted in the charging slot of the invention of communication connector.
Figure 8:
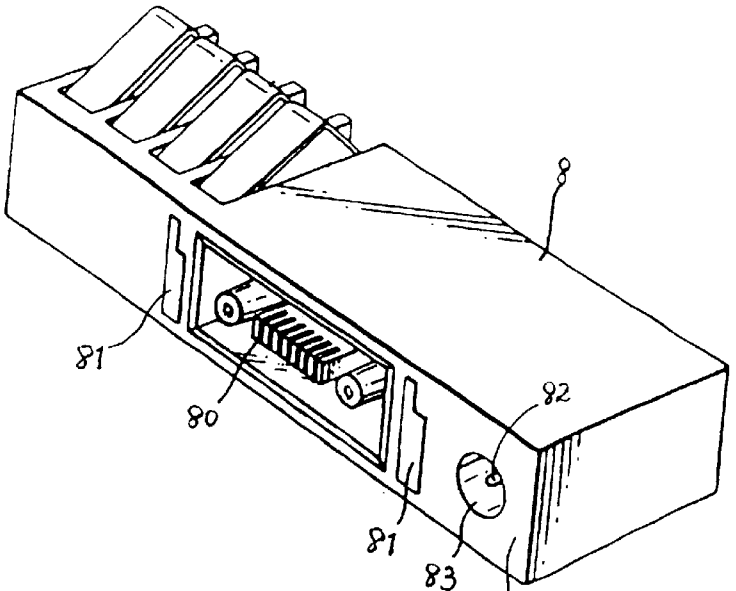
FIG.8 (PRIOR ART)
FIG. 8 is a perspective view of a prior art of communication connector.

As shown in FIG. 1, the present invention of communication connector comprises: an insulating unit 1, an obstruction unit 2, terminals 3, contact point terminals 4, and charging terminals 5, wherein the insulating unit 1 is a flattened and elongated square shape, on which is a plurality of terminal accommodating grooves 10 that serves to accommodate and position the terminals 3. On the left and right sides of the terminal accommodating grooves 10 are respectively one and two contact point accommodating grooves 11, 12, which serve to accommodate the contact point terminals 4. Also shown in FIG. 3, next to the contact point accommodating grooves 12 on the right are a charging terminal unit 13 and an assembling hole 14. On the charging terminal unit 13 is a side opening. As shown in FIG. 5, the opening 131 allows appropriate exposure of a contact point of the charging terminal 5 accommodated therein, to enable electrical contact with a DC plug 61 (to be described later).

Figure 2:
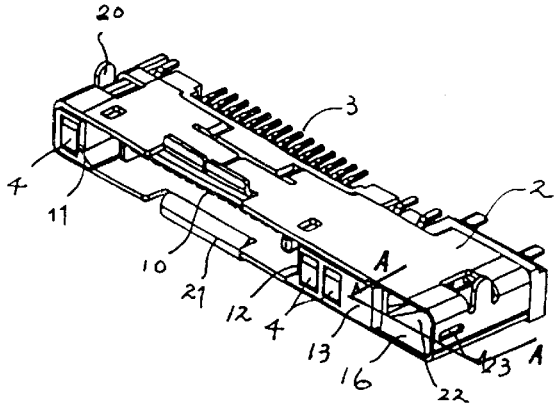
FIG. 2 is a perspective, assembled view of FIG. 1.
Figure 4:
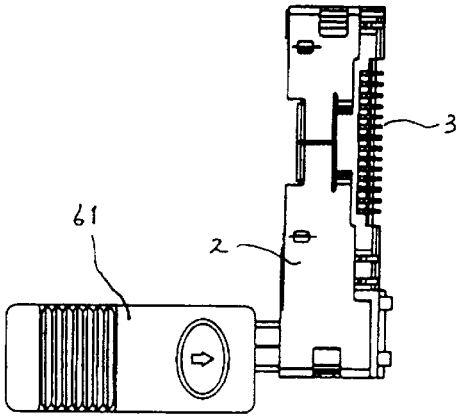
FIG. 4 is a top view of a DC charging plug that is inserted in the charging slot of the invention of communication connector.
Figure 7:
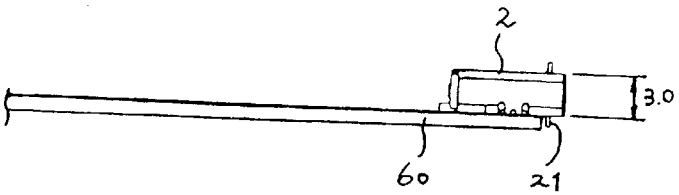
FIG. 7 is a side view of the invention of communication connector that is assembled onto a circuit board.

The obstruction unit 2 is made of metal, encompassing the insulating unit 1 and obstructing the terminal accommodating grooves 10, the contact point accommodating groove 11, 12 and the charging terminal unit 13, surrounding them to form a charging slot (shown in FIG. 2) to be inserted for connection by a DC charging plug. The charging slot 16 is a square shape as shown in FIGS. 4 and 5 that can be inserted by a square DC plug 61 at the inserting end. At the bottom of two sides of the obstruction unit 2 are positioning posts 20, which serve to position the connector on the circuit board. On the obstruction unit 2 and at the end of one side opposite the charging slot 16 is a bent spot plate 21. As shown in FIG. 7, the stop plate serves to press against the edge of the circuit board to prevent dislocation of the communication connector when it is inserted by the DC charging plug. On the obstruction unit 2 and opposite the charging slot 16 is a flexible check plate 22. The check plate 22 is a formation punched inwardly on the obstruction unit and near the opening of the charging slot 16, providing the charging slot with a clamping strength for connection purpose. One side of the check plate 22 away from the opening of the charging slot 16 is designed to be thinner to strengthen the operating flexibility of the check plate. On the side of the obstruction where the charging slot is located is a position-identifying unit 23. The position-identifying unit 23 is a long groove, forming a protruded obstacle inside the charging slot 16. With such a design, the matching DC charging plug must have a matching groove on its corresponding position, or else insertion is not possible.

Figure 9:
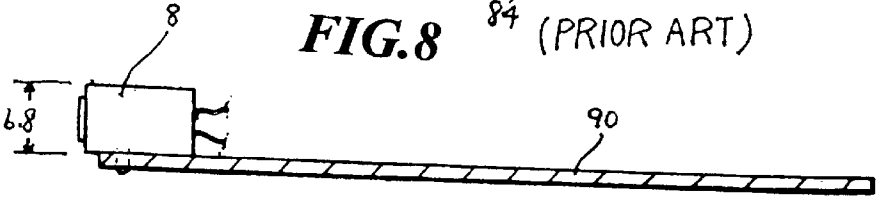
FIG.9 (PRIOR ART)
FIG. 9 is a side view of a prior art of communication connector that is assembled onto a circuit board.
Figure 6:
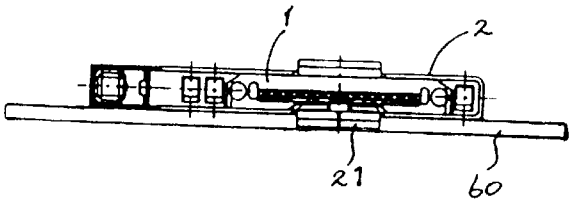
FIG. 6 is a front view of the invention of communication connector that is assembled onto a circuit board.

Referring to FIG. 1, the charging terminal 5 of the invention comprises a first charging terminal 50 and a second charging terminal 51. The first charging terminal 50 is assembled on the charging terminal unit 13 including a foundation part 501, and a contact part 520 that is extended from the foundation part 501 and is folded in reverse direction, and a welding part 503 that is extend from another side of the foundation part 501 and folded for horizontal welding onto the circuit board. The second charging terminal 51 is assembled on the assembling hole 14, including a column-shaped contact part 510. On the column-shaped contact part 510 is the extension of a U-shaped interference part 511. On one side of the U-shaped interference part 511 is a welding part 512 that can be welded horizontally onto the circuit board. Referring to FIGS. 6 and 7, as a result of the charging groove being framed by the metal obstruction unit 2, the integral height of the communication connector is reduced to approximately 3 mm, which is significantly less than the height of 6.8 mm (refer to FIG. 9) of the prior art when it is assembled to a circuit board 60. More importantly, since the charging slot is obstructed by the obstruction unit 2 that is made of metal, it will effectively prevent interference from outside signals.

In conclusion, the invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretations so as to encompass all such modifications and similar arrangements.

What is claimed is:

1. A communication connector adapted to be welded onto a circuit board of a mobile phone for providing charging functions, comprising:

a rectangular insulating unit defining a plurality of terminal accommodating grooves for receiving terminals therein, and a plurality of contact point terminal accommodating grooves for receiving contact point terminals therein, a charging terminal two accommodating grooves respectively accommodating a plurality of terminals and unit being formed on a side of the insulating unit for receiving a charging terminal therein; and an obstruction unit being integrally made of metal and shielding the insulating unit the obstruction unit and the charging terminal unit defines a charging slot for receiving therein a DC charging plug, a location identifying unit being formed on a side of the obstruction unit and extending into the charging slot for positioning the DC charging plug inserted into the charging slot.

2. The communication connector as claimed in claim 1, wherein the charging slot is bordered of a rectangular shape.

3. The communication connector as claimed in claim 1, wherein said charging terminal includes a first charging terminal and a second charging terminal, said first charging terminal including a foundation part, a contact part extending and adversely bent from a side of said foundation part, and a welding part an opposite side of said foundation part for surface mounting onto a circuit board, said second charging terminal including a column-shaped contact part, a U-shaped interference part extending from opposite edges of the contact part, and a welding part expending perpendicularly from an end of the contact part for surface mounting onto a circuit board.

4. A communication connector adapted to be welded onto a circuit board of a mobile phone for providing charging functions, comprising:

a rectangular insulating unit defining a plurality of terminal accommodating grooves and a plurality of contact point terminal accommodating grooves, and forming a charging terminal unit at a side thereof;

a plurality of terminals received in the terminal accommodating grooves and each having an end surface mounting on the circuit board;

a plurality of contact point terminal accommodating grooves received in the contact point terminal accommodating grooves and each having an end surface mounting on the circuit board;

a charging terminal being accommodated in the charging terminal unit and including a first charging terminal and a second charging terminal, the first charging terminal having a contact part extending into the charging slot, the second charging terminal having a column-shaped contact part; and an obstruction unit being integrally formed of metal, terminal accommodating grooves, contact point terminal accommodating grooves, and and shielding the insulating unit, the obstruction unit and the charging terminal unit defining a charging slot for engaging with a DC charging plug.

5. The communication connector as claimed in claim 4, wherein the charging slot is bordered of a rectangular shape.

6. The communication connector as claimed in claim 4, wherein said obstruction unit has a flexible check plate punched inwardly therefrom and extending into the charging slot for providing a clamping strength to connect with the DC charging plug.

7. The communication connector as claimed in claim 6, wherein said check plate has a thickness gradually reduced towards a free end thereof for enhancing flexibility.

8. The communication connector as claimed in claim 4, wherein a pair of positioning posts respectively protrude from a bottom of two sides of the obstruction unit 2 for positioning the connector on the circuit board.

9. The communication connector as claimed in claim 4, wherein a stop plate depends perpendicularly from a front edge of a side of the obstruction unit to press against an edge of the circuit board.

10. The communication connector as claimed in claim 4, wherein said first charging terminal includes a foundation part, and a welding part extending from the foundation part for surface mounting on the circuit board.

11. The communication connector as claimed in claim 4, wherein said second charging terminal has a U-shaped interference part substantially in a middle of the contact part, and a welding part extending from an end of the contact part for surface mounting onto the circuit board.

* * * * *